US009346656B2

(12) United States Patent
May

(10) Patent No.: US 9,346,656 B2
(45) Date of Patent: May 24, 2016

(54) STABILIZATION AND CONTROL OF A CRANE LOAD

(71) Applicant: Marvin M. May, Los Angeles, CA (US)

(72) Inventor: Marvin M. May, Los Angeles, CA (US)

( * ) Notice: Subject to any disclaimer, the term of this patent is extended or adjusted under 35 U.S.C. 154(b) by 0 days.

(21) Appl. No.: 14/788,138

(22) Filed: Jun. 30, 2015

(65) Prior Publication Data

US 2016/0002010 A1 Jan. 7, 2016

Related U.S. Application Data

(60) Provisional application No. 62/019,693, filed on Jul. 1, 2014.

(51) Int. Cl.
*B66C 13/06* (2006.01)
*B66C 23/06* (2006.01)

(52) U.S. Cl.
CPC *B66C 13/06* (2013.01); *B66C 23/06* (2013.01)

(58) Field of Classification Search
CPC ..... B66C 13/00; B66C 13/04; B66C 13/06; B66C 13/08; B66C 13/18; B66C 23/00; B66C 23/06; B66C 23/08; B66C 23/10; B66C 23/18; B66C 23/60; B66C 23/62; B66C 23/64; B66C 23/66; B66D 1/40
USPC ..... 212/223, 232, 242, 237, 239, 251, 255, 212/258, 259, 260, 262, 71, 76, 77, 83, 97, 212/271; 254/334
See application file for complete search history.

(56) References Cited

U.S. PATENT DOCUMENTS

| | | | |
|---|---|---|---|
| 249,847 | A | 11/1881 | MacDonald |
| 276,090 | A | 4/1883 | Sperry |
| 293,177 | A | 2/1884 | Joyce |
| 336,414 | A | 2/1886 | Kerr |
| 349,870 | A | 9/1886 | Woodward |
| 356,436 | A | 1/1887 | Anderson |
| 390,445 | A | 10/1888 | Bruce |
| 426,540 | A | 4/1890 | Matthaes |
| 440,045 | A | 11/1890 | Lewis |

(Continued)

FOREIGN PATENT DOCUMENTS

| | | | |
|---|---|---|---|
| CN | 2477597 Y | 2/2002 | |
| DK | WO 2014082641 A1 * | 6/2014 | ..... B66C 1/108 |

(Continued)

OTHER PUBLICATIONS

Non-Final Office Action (dated Feb. 17, 2010), U.S. Appl. No. 12/166,946, filed Jul. 2, 2008, Inventor: Marvin M. May, 9 pages.

(Continued)

*Primary Examiner* — Michael Mansen
*Assistant Examiner* — Juan Campos, Jr.
(74) *Attorney, Agent, or Firm* — Blakley, Sokoloff, Taylor & Zafman LLP

(57) ABSTRACT

A stabilizer cable has a first end and a second end, wherein the first end is coupled to a crane load. The stabilizer cable loops around a boom pulley that is attached to a crane boom, then runs through a traveler pulley, then loops around a floating pulley, then loops around a deflector pulley. The deflector pulley and the second end of the stabilizer cable are positioned such that an increase in tension of the stabilizer cable urges the suspended load toward the traveler pulley. Other embodiments are also described.

20 Claims, 2 Drawing Sheets

(56) References Cited

U.S. PATENT DOCUMENTS

| | | | | |
|---|---|---|---|---|
| 481,888 | A | 8/1892 | Bergeron et al. | |
| 572,576 | A | 12/1896 | Sjolander | |
| 640,099 | A | 12/1899 | Cotter | |
| 734,230 | A | 7/1903 | Hillier | |
| 864,405 | A | 8/1907 | Bowen | |
| 1,069,088 | A | 7/1913 | Taylor | |
| 2,313,958 | A | 3/1943 | Naab | |
| 3,367,297 | A | 2/1968 | Berger | |
| 3,519,248 | A | 7/1970 | Kushiro | |
| 3,750,686 | A | 8/1973 | Cook | |
| 3,796,281 | A | 3/1974 | Dowling | |
| 3,860,092 | A | 1/1975 | Holmes | |
| 3,966,170 | A | 6/1976 | McKenna | |
| 3,967,699 | A | 7/1976 | Jasch | |
| 4,018,306 | A | 4/1977 | Lyons | |
| 4,111,281 | A | 9/1978 | Jacobs | |
| 4,204,664 | A | 5/1980 | Bryan, Jr. | |
| 4,209,077 | A | 6/1980 | Yui et al. | |
| 4,318,533 | A | 3/1982 | Port | |
| 4,355,699 | A | 10/1982 | Smith, Jr. | |
| 4,406,351 | A | 9/1983 | Littlejohn et al. | |
| 4,424,884 | A | 1/1984 | Smith, Jr. | |
| 4,458,781 | A | 7/1984 | Ellis et al. | |
| 4,469,198 | A | 9/1984 | Crump | |
| 4,474,263 | A | 10/1984 | Christopher | |
| 4,502,570 | A | 3/1985 | Westerlund | |
| 4,512,438 | A | 4/1985 | Vilchek et al. | |
| 4,538,703 | A | 9/1985 | Ellis et al. | |
| 4,830,141 | A | 5/1989 | Montaigne | |
| 4,919,228 | A | 4/1990 | Stefan | |
| 5,090,666 | A | 2/1992 | May | |
| 5,095,841 | A | 3/1992 | Santos et al. | |
| 5,101,935 | A | 4/1992 | LaBianca | |
| 5,253,734 | A | 10/1993 | Laurutis | |
| 5,280,879 | A | 1/1994 | Kreuter | |
| 5,355,975 | A | 10/1994 | Laurutis | |
| 6,079,520 | A | 6/2000 | Black et al. | |
| 6,089,547 | A | 7/2000 | Juelich et al. | |
| 6,318,503 | B1 | 11/2001 | Hernandez | |
| 6,364,063 | B1 | 4/2002 | Aulanko et al. | |
| 6,435,595 | B1 | 8/2002 | Chenowth | |
| 9,238,569 | B2 * | 1/2016 | Sorensen | B66C 23/185 |
| 2004/0118635 | A1 | 6/2004 | Sun et al. | |
| 2004/0154869 | A1 | 8/2004 | May | |
| 2005/0109724 | A1 | 5/2005 | Frumau et al. | |
| 2005/0230670 | A1 | 10/2005 | Kataoka | |
| 2005/0252719 | A1 | 11/2005 | May | |
| 2011/0272377 | A1 * | 11/2011 | Willim | B66C 23/185 212/285 |
| 2012/0061341 | A1 * | 3/2012 | Richter | B66C 13/08 212/348 |
| 2014/0263141 | A1 * | 9/2014 | May | B66C 23/62 212/242 |
| 2014/0263142 | A1 | 9/2014 | Billiot et al. | |

FOREIGN PATENT DOCUMENTS

| | | | |
|---|---|---|---|
| JP | 2001520926 | | 11/2001 |
| JP | 2003285985 | | 10/2003 |
| RU | 1836282 | | 8/1993 |
| RU | 1836282 | A3 | 8/1993 |

OTHER PUBLICATIONS

Non-Final Office Action (dated Apr. 3, 2006), U.S. Appl. No. 10/763,596, filed Jan. 23, 2004, First Named Inventor: Marvin M. May, 9 pages.

Final Office Action (dated Feb. 26, 2007), U.S. Appl. No. 10/763,596, filed Jan. 23, 2004, First Named Inventor: Marvin M. May, 10 pages.

Non-Final Office Action (dated Aug. 28, 2007), U.S. Appl. No. 10/763,596, filed Jan. 23, 2004, First Named Inventor: Marvin M. May, 7 pages.

Final Office Action (dated Feb. 25, 2008), U.S. Appl. No. 10/763,596, filed Jan. 23, 2004, First Named Inventor: Marvin M. May, 6 pages.

Non-Final Office Action (dated Jan. 26, 2011), U.S. Appl. No. 12/434,521, filed May 1, 2009, First Named Inventor: Marvin M. May, 11 pages.

Supplementary Partial European Search Report (dated Nov. 9, 2011), Application No. 04705344.2-1269, Date Filed—Jan. 26, 2004, Inventor: Marvin M. May, 4 pages.

Final Office Action (dated Dec. 9, 2011), U.S. Appl. No. 12/434,521, filed May 1, 2009, First Named Inventor: Marvin M. May, 12 pages.

Non-Final Office Action (dated Feb. 16, 2012), U.S. Appl. No. 12/966,846, filed Dec. 13, 2010, First Named Inventor: Marvin M. May, 19 pages.

Final Office Action (dated Jul. 3, 2012), U.S. Appl. No. 12/966,846, filed Dec. 13, 2010, First Named Inventor: Marvin M. May, 13 pages.

Non-Final Office Action (dated Dec. 3, 2012), U.S. Appl. No. 12/434,521, filed May 1, 2009, First Named Inventor: Marvin M. May, 8 pages.

Non-Final Office Action (dated Aug. 14, 2013), U.S. Appl. No. 12/966,846, filed Dec. 13, 2010, First Named Inventor: Marvin M. May, 14 pages.

Non-Final Office Action (dated Oct. 4, 2013), U.S. Appl. No. 12/434,521, filed May 1, 2009, First Named Inventor: Marvin M. May, 13 pages.

PCT International Search Report (dated Nov. 8, 2006), International Application No. PCT/US04/02243—International Filing Date Jan. 26, 2004, 13 pages.

Non-Final Office Action (dated Apr. 11, 2008), U.S. Appl. No. 11/185,518, filed 097/19/2005 Inventor: Marvin M. May, 5 pages.

Non-Final Office Action (dated Feb. 18, 2015), U.S. Appl. No. 14/209,947, filed Mar. 13, 2014, First Named Inventor: Marvin M. May, 23 pages.

Non-Final Office Action (dated Apr. 16, 2015), U.S. Appl. No. 14/483,801, filed Sep. 11, 2014, First Named Inventor: Marvin M. May, 19 pages.

Final Office Action (dated Aug. 6, 2015), U.S. Appl. No. 14/209,947, filed Mar. 13, 2014, First Named Inventor: Marvin M. May, 15 pages.

"Der Hochretter Rettet sicher aus hochster Gefetn", *Wahlefeld, Hochretter, Wahlefeld Stahl-Metall-Maschinenbau*, Germany, 15 pages.

"TIA Standard—Standard for Installation, Alteration and Maintenance of Antenna Supporting Structures and Antennas", *TIA Advancing Global Communications, TIA-1019-A*, Jan. 2012, *Telecommunications Industry Association*, 87 pages.

"Triple Barrel Tagline", *Operation & Maintenance Manual, Rud • O • Matic®, Rudomatic, Inc.*, Los Angeles, CA, USA "Admitted Prior Art", 12 pages.

Exterior, Non-Final Office Action (dated Apr. 21, 2006), U.S. Appl. No. 11/185,518, filed Jul. 19, 2005, Inventor: Marvin M. May, 8 pages.

Exterior, Non-Final Office Action (dated Sep. 25, 2006), U.S. Appl. No. 11/185,518, filed Jul. 19, 2005, Inventor: Marvin M. May, 6 pages.

Exterior, Non-Final Office Action (dated Apr. 6, 2007), U.S. Appl. No. 11/185,518, filed Jul. 19, 2005, Inventor: Marvin M. May, 8 pages.

Exterior, Final Office Action (dated Jul. 16, 2007), U.S. Appl. No. 11/185,518, filed Jul. 19, 2005, Inventor: Marvin M. May, 7 pages.

Exterior, Non-Final Office Action (dated Apr. 11, 2008), U.S. Appl. No. 11/185,518, filed Jul. 19, 2005, Inventor: Marvin M. May, 5 pages.

Exterior, Final Office Action (dated Nov. 18, 2008), U.S. Appl. No. 11/185,518, filed Jul. 19, 2005, Inventor: Marvin M. May, 11 pages.

Exterior Elevator, LLC, "Chinese Office Action dated Jul. 18, 2008 with translation", CN Application No. 20040008305.1, 14 pages.

* cited by examiner

STABILIZATION AND CONTROL OF A CRANE LOAD

This application claims the benefit of the earlier filing date of U.S. Provisional Patent Application No. 62/019,693, filed Jul. 1, 2014.

An embodiment of the invention is generally related to stabilization of the swinging movement of, and independent horizontal position control of a crane's suspended load. Other embodiments are also described.

BACKGROUND

A crane is a type of machine that is equipped with a hoist and uses an upper pulley with a cable looped around it, to lift and lower a load, while also allowing the load as suspended to be moved horizontally. A load may be picked up by the crane and moved horizontally, by rotating a base of the crane, such as using a turntable. With a mobile crane, the base of the crane can move by rolling on tracks or wheels, thereby allowing further control of the horizontal positioning of the load. Yet another way to move the suspended load horizontally is to change the angle of the boom from which the load is suspended. In all such techniques, either the boom itself or the base to which the boom is attached needs to be moved, in order to effectuate horizontal positioning of the suspended load. A further characteristic of a crane is that the suspended load will tend to swing from (sideways), for example when the boom angle is changed or as the base is turned on a turntable. In addition, the suspended load is also susceptible to swinging due to gusty winds. One solution to control the swinging of a suspended load is to provide a tag line which is a rope that is attached to the load during lifting and that allows a rigger (a person standing on the ground below the load) to pull on the tag line to thereby apply a force that hopefully counters the forces created by the gusty wind and the tendency of the suspended load to rotate about itself.

SUMMARY

An embodiment of the invention is a system for stabilizing a load that is suspended from a crane, that in one case may avoid the need for a tag line and a rigger. The system may also be used to position the suspended load sideways (or horizontal position control), without having to move the crane boom or the base of the crane to which the boom is attached. In one embodiment, the system may be added to an existing crane, through the addition of a boom pulley that is attached to the crane boom, a floating pulley, a traveler pulley, a deflector pulley, and a stabilizer cable. The stabilizer cable may be arranged to form a closed loop by being coupled to the load and looped around the boom pulley, through the traveler pulley, looped around the floating pulley, and looped around the deflector pulley. The other end of the stabilizer cable is positioned, together with the deflector pulley, so that an increase in tension of the stabilizer cable urges the suspended load toward the traveler pulley. This increase in tension of the stabilizer cable may be achieved by a means for pulling the floating pulley. This allows the horizontal positioning of the suspended load to be changed, for example in a direction from the suspended load to the crane boom. Other embodiments are also described, including an application of the system for a wrecking ball load.

One or more embodiments of the invention may help reduce the risk of crane accidents that result from unwanted movement of hanging loads. Further, they may enhance the opportunity to plan and program cranes to enable them to automatically raise and lower loads. Still further, they may help prevent unintended movements of the loads that are caused by winds and by adjustments of the crane boom. Yet further, they may provide additional, possibly safer options for the positioning of the crane on the worksite. Even further, they may reduce the overturning moment on the crane, by moving and holding the load closer to the crane boom.

In one aspect of the invention, an auxiliary means is provided for a crane operator, and his assistants, to remotely place, control and adjust the horizontal position of a formerly freely swinging, hanging load, throughout the entire raising and lowering process.

Freely swinging loads exert unplanned forces on the crane. The swinging can cause damage and injuries by the load hitting personnel and structures. Swinging sometimes causes cranes to collapse. Heavy winds cause loads to swing and can require shutting down crane operations.

Cranes are typically positioned farther away so as to reduce the likelihood of the load accidentally hitting other structures or personnel. This can require shutting off automobile traffic, or not operating the crane during desired times. An embodiment of the invention may permit additional location possibilities.

Without being able to control the location/position and velocity of a swinging load, it is difficult to accurately anticipate and counteract the resulting forces. Preventing accidents is dependent on the experience and skill of the crane operator. An embodiment of the invention is a tool to help crane operators do that job.

Aside from preventing unwanted swinging, being able to know, control and adjust the position of the hanging load is an additional, important safety feature. Crane operators are able to more accurately anticipate and pre-compute the resulting forces on the components of the crane and the overturning moments of the crane structure. An embodiment of the invention allows the movements of the crane to be programmed. Programming allows virtual testing of alternative planned crane operations, to discover possible problems before they happen. Programming can help minimize operating errors.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Crane Mechanism

Figure 1:
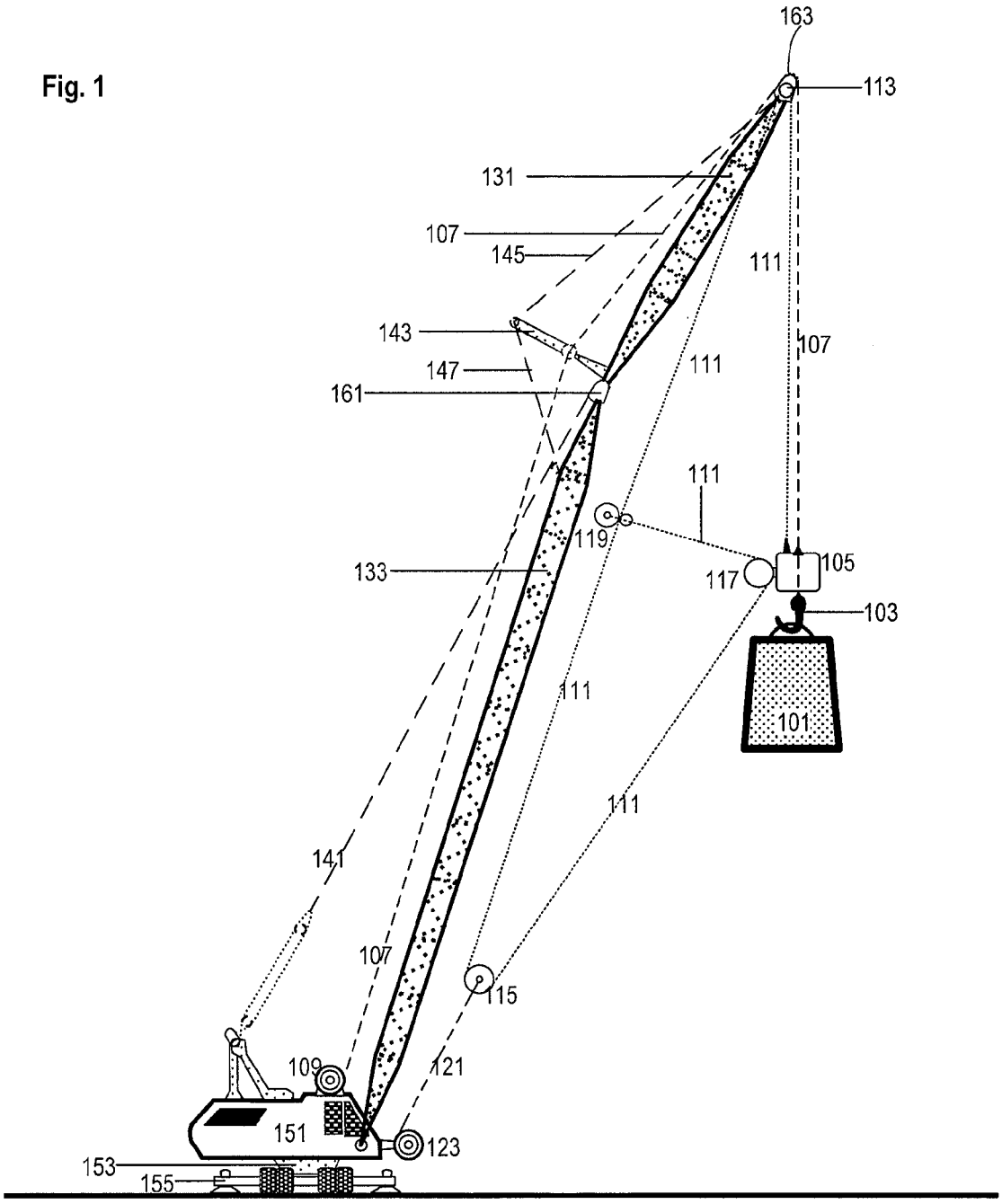
FIG. 1 is an illustration of a crane that is using one embodiment of the invention to stabilize its suspended load.

FIG. 1 is an illustration of an example crane and one embodiment of a load stabilization or horizontal position control method and system. The crane illustrated in FIG. 1 is a jib crane, but the stabilization and horizontal control method and system can be applied to other types of cranes as well, such as a tower crane, a self-erecting crane, a telescopic crane, a hammerhead crane, a level luffing crane, a gantry crane, a deck crane, a bulk-handling crane, a loader crane, a stacker crane, a truck-mounted crane, a sidelift crane, a rough-terrain crane, a pick-and-carry crane, a carry deck crane, a telescopic handler crane, a crawler crane, a railroad crane, a floating crane, an aerial crane, or a different type of crane or crane-like mechanism (e.g., a fireman's ladder).

In the embodiment pictured in FIG. 1, the load 101 is being held by the crane. The crane serves to raise and lower the load 101 while the load is coupled to and suspended from a lifting cable 107. It should be understood that the term "cable" may refer to any one of a cable, rope, thread, twine, or other similar lengthy object that can be used in concert with a system of pulleys. In one embodiment, the load 101 may be a container that can carry people (e.g., similar to an elevator car) or that can carry other, equipment, vehicles, or cargo (e.g., a freight container, crate, or shipping container). In particular, the load is held by a hook 103, which is attached to a ballast 105. In some embodiments, the hook 103 may be an electromagnet or other coupling device, and use of the term "hook" within this document should be understood to include not just a curved or bent piece of a strong material, as shown in the drawings, but also an electromagnet or other coupling device. The ballast 105 is a common element in various types of cranes and typically takes the form of a solid weight that hangs from the lifting cable 107 in order to keep the lifting cable 107 taut (even when there is no load 101 hanging from it). The ballast 105 is sometimes referred to as a "headache ball" or a "headache block" depending on its shape, which can vary widely in different embodiments. In some embodiments, the hook 103 is rigidly attached to the ballast 105, and the lifting cable 107 is tied to the ballast 105. In other embodiments, the hook 103 is attached to the ballast 105 by being suspended from the ballast, e.g. using a cable optionally through a sheave or a pulley. In other embodiments, the hook 103 is attached directly (or through a pulley or sheave) to an end of the lifting cable 107, which runs through the ballast 105.

Another end of the lifting cable 107 is wrapped around a lifting winch 109, which is coupled to a base 151 (sometimes referred to as the "slewing platform") of the crane. In some embodiments, the base 151 contains a turntable 153 so that the crane in its entirety can be rotated. In some embodiments, the base 151 can contain wheels (i.e., the base 151 may be towable by a vehicle or may itself be a vehicle). In some embodiments, the base 151 contains an outrigger 155 to take the weight off of the wheels and keep the crane from falling over. In some embodiments, the base 151 contains or may be attached to a counterweight (not shown).

In some embodiments, the base 151 is coupled to the bottom of a boom, specifically a lower boom 133 in this example (sometimes referred to as a "mast"), where the lower boom 133 is attached to an upper boom 131 at a boom point 161. The lower boom 133 and upper boom 131 may be collectively referred to as the "boom" for the purposes of this document. In some embodiments, the boom is not segmented as shown in FIG. 1, but is instead a single entity which may be arched, angled, or straight. The boom may be latticed as shown in FIG. 1, or it may be solid, or it may be hollow, or it may even be a ladder. In some embodiments, further structures are included to help support or move the boom. For example, in the embodiment of FIG. 1, the boom point 161 is connected to the base 151 using one or more boom guy lines 141. In some embodiments, boom guy lines 141 simply help to support the lower boom 133, while in other embodiments, the boom guy lines 141 may be wrapped around a winch at or near the base 151, and can be used to change the angle of the lower boom 133 relative to the ground. Also in the embodiment of FIG. 1, a jib strut 143 extends from one of (a) the boom point 161, (b) the upper boom 131, or (c) the lower boom 133. In some embodiments, jib strut 143 serves as additional support, and connects to the lower boom 133 with a jib back stay 147 and connects to the upper boom 131 with a jib guy line 145. In other embodiments, the jib strut 143, jib back stay 147, and jib guy line 145 may be coupled to one or more winches or similar mechanisms that can be used to adjust the angle between the lower boom 133 and the upper boom 131 at boom point 161. In other embodiments, the structures described (boom guy lines 141, jib strut 143, jib back stay 147, and jib guy line 145) may be missing, or may be replaced by other structures or mechanisms not depicted in FIG. 1 that serve to change the angle of the boom relative to the horizontal plane of the base 151.

The lifting cable 107 as depicted in FIG. 1 starts with one end wrapped around the lifting winch 109. In one embodiment, the lifting winch 109 is a drum winch. In another embodiment, the lifting winch 109 could be a traction winch mechanism, which would include a tail line and cable winder (not shown). The lifting winch 109 may be electrically or hydraulically motorized. The lifting cable 107 runs along the lower boom 133 and the upper boom 131. In the embodiment of FIG. 1, the lifting cable 107 runs through a portion of the jib strut 143 to help separate it slightly from the lower boom 133 and upper boom 131 at the boom point 161, but in other embodiments the lifting cable 107 need not run through the jib strut 143. In some embodiments, for example, the lifting cable 107 may run through the center or along a side of the lower boom 133 and the upper boom 131. The lifting cable 107 then runs up the upper boom 131 and eventually wraps around an upper sheave 163 at the far end of the upper boom 131. The upper sheave 163 may be a pulley or pulley-like device in some embodiments. Once the lifting cable 107 runs past the upper sheave 163, the lifting cable runs downward to the ballast 105 and the hook 103.

While the first end of the lifting cable 107 in FIG. 1 is wrapped around the lifting winch 109, the second end of the lifting cable 107 is coupled to the load assembly (e.g., the load 101, the hook 103, and the ballast 105). In some embodiments, the lifting cable is attached only to the ballast 105, and the ballast 105 is separately attached to the hook 103. In other embodiments, the lifting cable is attached only to the hook 103, and the ballast 105 can be separately coupled to the hook 103. In some embodiments, the attachment mechanisms used to couple the lifting rope 107 to the load 101, by way of the hook 103 (and optionally through the ballast 105) may be any one of a snap hook, a winch, a cable tie or knot, or some other mechanism through which an end of a cable may be attached to an object. It should be understood that the term "cable" may refer to any one of a cable, rope, thread, twine, or other similar lengthy object that can be used in concert with a system of pulleys.

Figure 2:
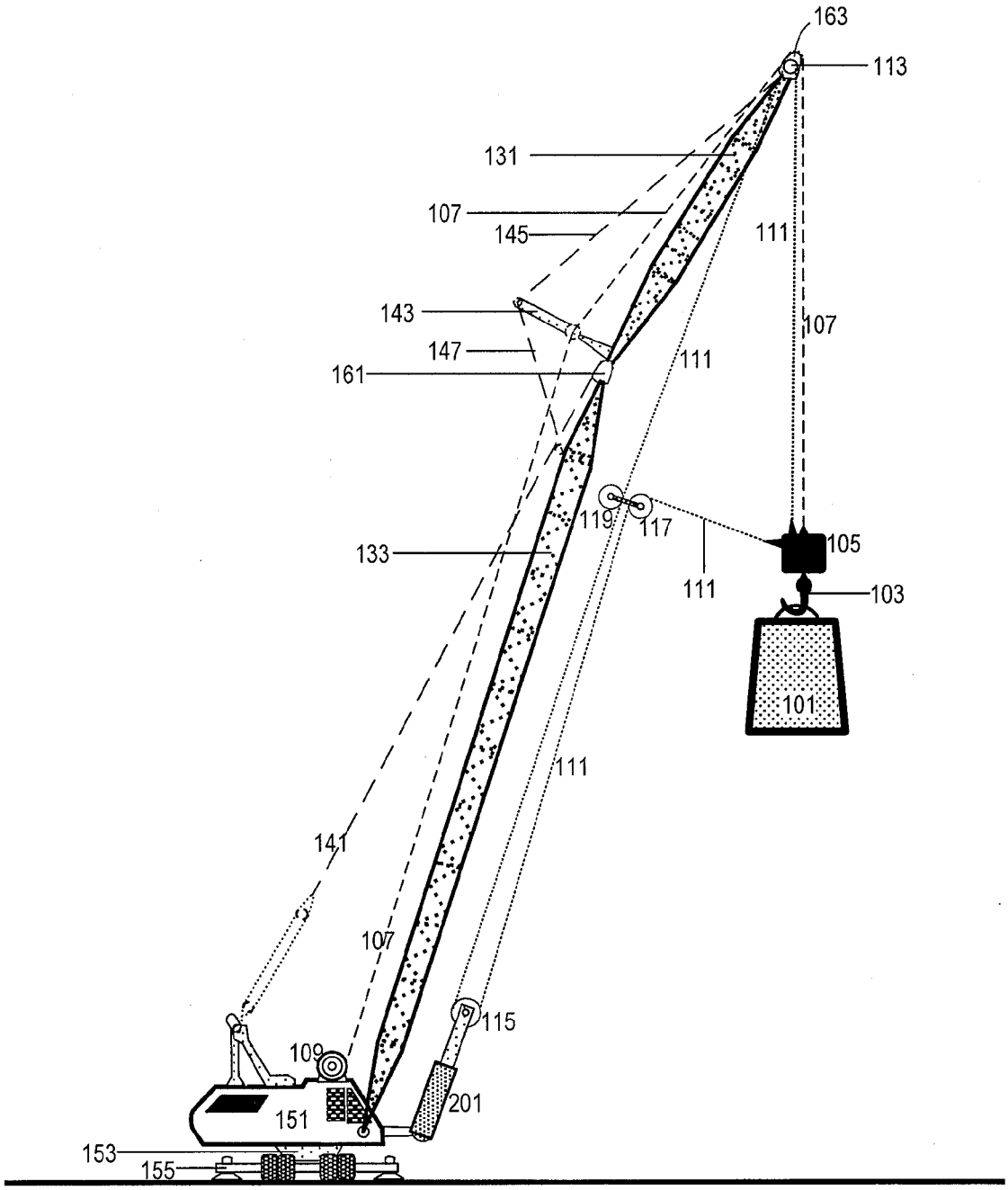
FIG. 2 is an illustration of a crane that is using another embodiment of the invention.

In an alternate embodiment to the one pictured in FIG. 1 and FIG. 2, the lifting cable 107 could be coupled to the load 107, by way of the hook 103 and/or the ballast 105, using a pulley (e.g., a sheave) that is attached to a hook block (not shown). The lifting cable 107 in that case loops around the pulley of the hook block before running back up towards the upper sheave 163, where the second end of the lifting cable 107 can be tied (a) at or near the upper sheave 163, (b) at or near the base 151 after the lifting cable 107 loops all the way back through or alongside the upper boom 131 and lower boom 133, or (c) somewhere along the upper boom 131, boom point 161, or lower boom 133. In some embodiments, the attachment mechanisms used to couple the lifting rope 107 to the above-mentioned possible second end-points may be any one of a snap hook, a winch, a cable tie or knot, or some other mechanism through which an end of a cable may be attached to an object.

The previous paragraphs referring to FIG. 1 describe the crane mechanism itself. It should be understood that in the context of the method and system presented herein, the crane displayed in the FIG. 1 may be substituted by a different type of crane or crane-like mechanism, e.g. one that does not have a jib. For example, in some embodiments, the crane boom shown may be a ladder, such as a fireman's ladder.

Stabilization and Horizontal Control System and Method

The stabilization and horizontal control system and method presented herein has the effect of controlling the horizontal movement (e.g., movement that is substantially parallel to the ground or substantially perpendicular to the direction in which the load may be raised or lowered by the lifting cable 107) of a load 101. For example, the stabilization and horizontal control system can be used to move the load 101 sideways into a desired position, without moving the upper boom 131 or lower boom 133 of the crane and without moving the base 151 of the crane. It can also be used to stabilize the load 101, e.g. to protect the load 101 from gusty winds that might otherwise push the load 101 and can cause it to sway or swing horizontally (sideways) and potentially cause damage to nearby buildings, trees, or even to the upper boom 131 or lower boom 133 of the crane.

The stabilization and horizontal control system and method involves the use of a stabilizer cable 111 that is separate from the lifting cable 107. In one embodiment, a first end of the stabilizer cable 111 couples to the load 101 through an attachment mechanism of the ballast 105 and/or the hook 103, or is attached directly to the load 101 (particularly if the load 101 is actually a container that can hold smaller items such as people, vehicles, or cargo within it). In some embodiments, this attachment mechanism may be any one of a snap hook, a winch, a cable tie or knot (such as if the stabilizer cable 111 is tied around the ballast 105, hook 103, or load 101), or some other mechanism through which an end of (or a portion at that end of) a cable may be attached to an object. It should be understood that the term "cable" may refer to any one of a cable, rope, thread, twine, or other similar lengthy object that can be used in concert with a system of pulleys.

From the ballast 105 or load 101, the stabilizer cable 111 runs upward and wraps around a boom pulley 113. In the embodiment of FIG. 1, the boom pulley 113 is attached to part of the upper boom 131 (and in particular at the top end adjacent to the upper sheave 163). In other embodiments, the boom pulley 113 could be attached to part of the lower boom 133 or to the boom point 161. In another embodiment, the boom pulley 113 is a floating or suspended pulley that is attached via a cable (not shown) to one or more of (a) the upper boom 131, (b) the boom point 161, and (b) the lower boom 133.

From the boom pulley 113, the stabilizer cable 111 runs downward. The stabilizer cable then passes through a traveler pulley 119 on its way down to a floating pulley 115. As a result, the traveler pulley 119 is positioned in a manner that allows it to freely travel along the length of a taut section of the stabilizer cable 111 that runs directly between the boom pulley 113 and the floating pulley 115 as shown.

After passing through the traveler pulley 119, the stabilizer cable 111 continues downward and eventually wraps around the floating pulley 115. The floating pulley 115 is coupled to a pulling mechanism (also referred to as a "means for pulling"). The pulling mechanism may be, as depicted in the embodiment of FIG. 1, an adjuster cable 121 and adjuster winch 123. The pulling mechanism may alternately be, as depicted in the embodiment of FIG. 2, a motorized linear actuator 201. Specifically, in the embodiment of FIG. 1, the floating pulley 115 is coupled to a first end of an adjuster cable 121. The second end of the adjuster cable 121 is wrapped around an adjuster winch 123. The adjuster winch 123 is coupled to some portion of one of (a) the base 151 (as shown in FIG. 1), or (b) the lower boom 133, so that it can rotate with the turntable 153. In one embodiment, the adjuster winch 123 is a drum winch. In another embodiment, the adjuster winch 123 is a traction winch mechanism, which would include a tail line and cable winder (not shown). In some embodiments, the adjuster winch 123 is motorized, whereas in others it is not. The adjuster winch 123 may increase, hold, or decrease tension in the adjuster cable 121, which in turn may bring the floating pulley 115 closer to, maintain the same distance from, or allow the pulley 115 to move further away from the adjuster winch 123 (while the entirety of the stabilizer cable 111 remains taut as shown). The adjuster cable 121 and adjuster winch 123 depicted in FIG. 1 illustrate one type of pulling mechanism that the floating pulley 115 may be coupled to; in other embodiments, such as the embodiment illustrated in FIG. 2, other types of pulling mechanisms can be used.

After wrapping around the floating pulley 115, the stabilizer cable 111 runs upward toward the load 101 and ballast 105 until wrapping around a deflector pulley 117. In the embodiment of FIG. 1, the deflector pulley 117 may be attached to one of (a) the ballast 105, (b) the hook 103, or (c) the load 101 (particularly if the load 101 is actually a container that can hold smaller loads such as people, vehicles, cargo within it). Alternate positions are possible for the deflector pulley 117, as visible for example in FIG. 2.

According to the embodiment of FIG. 1, after wrapping around the deflector pulley 117, the stabilizer cable 111 runs substantially horizontally toward the section of the stabilizer cable 111 between the boom pulley 113 and the floating pulley 115 until the second end of the stabilizer cable 111 (the end that is not coupled to the ballast 105 or load 101) is attached to the traveler pulley 119. In the embodiment of FIG. 1, the traveler pulley 119 is depicted as a device containing at least one pulley, including in this case two pulleys, one on either side of the section of the stabilizer cable 111 that the traveler pulley 119 is positioned to run along (i.e., the section of the stabilizer cable 111 that runs directly between the boom pulley 113 and the floating pulley 115). In another embodiment, the traveler pulley 119 could be a device containing only a single pulley (i.e., the leftmost pulley of the traveler pulley device 119 as depicted in FIG. 1). In yet another embodiment, the traveler pulley device 119 could contain more than two pulleys.

The stabilizing and horizontal control method and system described above can be configured by an operator (human, computer, or machine) using the adjuster winch 123. As described above, the adjuster winch 123 may increase, hold, or decrease tension in the adjuster cable 121, which in turn may (a) bring the floating pulley 115 closer to, (b) maintain the same distance from, or (c) allow the floating pulley to move away from, the adjuster winch 123. When the winch 123 is activated to rotate in a direction that takes in the cable 121, the floating pulley 115 is brought closer to the adjuster winch 123, and the distance of segment of the stabilizer cable 111 that runs directly between the boom pulley 113 and the floating pulley 115 increases. As a result, the tension throughout the stabilizer cable 111 is increased, which forces or urges the deflector pulley 117 closer to the traveler pulley 119. Because the deflector pulley 117 is attached to one of (a) the ballast 105, (b) the hook 103, or (c) the load 10, this will cause these structures (which are all coupled to and suspended from the lifting rope 107) to also move closer to the traveler pulley 119. The traveler pulley 119 is, in FIG. 1, located closer horizontally to the crane boom than the ballast 105, hook 103, and load 101 are. Accordingly, activating the adjuster winch 123 to increase the tension in the adjuster cable 121 causes the load 101 to move sideways closer to the crane, or at least limits the amount that the load assembly (the load 101 or hook 103 or ballast 105) can swing horizontally away from the crane boom. Limiting the load assembly from swaying horizontally away from the crane boom in this manner should also limit swinging in the opposite direction, since the load assembly is limited from completing a full pendulum swing.

On the other hand, allowing the adjuster winch 123 to rotate in the opposite direction will decrease the tension in the adjuster cable 121 (lets out the adjuster cable 121), which shortens the segment of the stabilizer cable 111 that runs directly between the floating pulley 115 and the boom pulley 113, and reduces tension in it, and thereby gives the load 101 more leeway to swing horizontally away from the crane boom. This reduction in the sideways force upon the load assembly may even function to allow gravity to move the load 101 horizontally away from the crane boom, by virtue of the weight of the block 105, hook 103 and load 101 (if the lifting cable 107 was not entirely vertical). If necessary in case of winds, or if otherwise desirable, a motorized propeller fan (not shown) may be added to the load assembly which propels the load away from the boom towards the vertical (or even beyond the vertical).

The adjuster winch 123 should be capable of applying one of (a) a tightening force to increase the tension in the stabilizer cable 111, (b) a holding force to maintain a constant tension in the stabilizer cable 111, or (c) a loosening force operable to decrease the tension in the stabilizer cable 111. In one embodiment, each of these forces (tightening, holding, and loosening) is calculated at a specific quantity, and may take into account the specifications of the crane (e.g., horizontal distance between the load 101 and the lower boom 133 when the segment of lifting cable 107 between the load and the upper sheave 163 is entirely vertical), the specifications of the load 101 (e.g., weight, fragility, or size of the load 101), or the current altitude of the load 101 as held by the crane. In another embodiment, each of these forces (tightening, holding, and loosening) is actually a range of possible force quantities.

FIG. 2 is an illustration of a jib crane using other embodiments of the stabilization and horizontal control method and system. Differences between the embodiments depicted in FIG. 2 from the embodiments depicted in FIG. 1 include (a) usage of a linear actuator 201 (sometimes referred to as a "cylinder" or a "piston") as part of the pulling mechanism that pulls on the pulley 115, and (b) a different positioning of the deflector pulley 117 and attachment point for the second end of the stabilizer cable 111.

Specifically, while in FIG. 1 the floating pulley 115 was attached to an adjuster cable 121 whose other end was wrapped around an adjuster winch 123, the floating pulley 115 of FIG. 2 is attached to the actuator rod (sometimes referred to as a "piston rod" or "inner cylinder") of a linear actuator 201. The linear actuator 201 is powered by a motor that may be, for example, hydraulic, pneumatic, or electromechanical. Powering the linear actuator 201 to let out the rod a limited amount (under control) has the effect of allowing the floating pulley 115 to move upward, decreasing the tension in the stabilizer cable 111. Conversely, pulling in the rod has the effect of pulling the floating pulley 115 downward, increasing the tension in the stabilizer cable 111. If the linear actuator 201 is electromechanical, it may be, for example, a rack and pinion actuator, or it may involve gears, rails, pulleys, chains, multi-turn valves, or similar devices. The linear actuator 201 is attached to some portion of one of (a) the base 151 (as shown in FIG. 2), or (b) the lower boom 133, so as to rotate with the base of the crane on the turntable.

A second difference between the embodiment depicted in FIG. 1 and the embodiment depicted in FIG. 2 is that the deflector pulley 117 is positioned differently in FIG. 2 than it is in FIG. 1. In FIG. 2, the deflector pulley 117 is attached to the traveler pulley 119 (instead of to the load 101 or ballast 105 or hook 103). The axles of the deflector pulley 117 and the traveler pulley 119 are attached to each other, either through a rigid connection or through a cable or rope. Despite the change in position of the deflector pulley 117, however, the stabilizer cable 111 in FIG. 2 still runs to and wraps around the deflector pulley 117 after wrapping around the floating pulley 115. Here, however, a different attachment point is provided for the second end of the stabilizer cable 111, namely at the load 101, the hook 103, or the ballast 105. In FIG. 2, the stabilizer cable 111 starts at a first attachment mechanism at the (a) load 101, (b) hook 103, or (c) ballast 105, then runs up to and around the boom pulley 113, then runs through the traveler pulley 119 and down to and around the floating pulley 115, then runs up to and around the deflector pulley 117, then runs to a second attachment mechanism at the (a) load 101, (b) hook 103, or (c) ballast 105. In contrast, in FIG. 1, the stabilizer cable 111 starts at a first attachment mechanism at the (a) load 101, (b) hook 103, or (c) ballast 105, then runs up to and around the boom pulley 113, then runs down through the traveler pulley 119 and down to and around the floating pulley 115, then runs up to and around the deflector pulley 117, then runs to a second attachment mechanism at the traveler pulley 119.

Still referring to FIG. 2, the stabilizing method and system described is configured by an operator (e.g., human, computer, or machine) using the linear actuator 201. As described above, the linear actuator 201 and its motor may exert force to bring the floating pulley 115 a) closer to, b) maintain the same distance from, or c) further away from, the base 151 or the ground. When the floating pulley 115 is brought closer to the base 151 or to the ground, the distance of the segment of the stabilizer cable 111 directly between the boom pulley 113 and the floating pulley 115 increases. As a result, the tension throughout the stabilizer cable 111 is increased. Because the stabilizer cable 111 is attached to one of (a) the ballast 105, (b) the hook 103, or (c) the load 101, this will cause these structures (which are typically all coupled to the lifting rope 107) to be urged horizontally towards the traveler pulley 119. The deflector pulley 117 and traveler pulley 119 are, in FIG. 2, located closer horizontally to the crane boom than the ballast 105, hook 103, and load 101 are.

As noted above, activating the linear actuator 201 pulls the floating pulley 115 downward and causes the load 101 to move closer to the traveler pulley 119 (and the rest of the crane), or at least limits the amount that the load 101 can swing horizontally away from the crane. Limiting the load 101 from swaying horizontally away from the crane in this manner should also limit the load 101 from swinging towards the crane, since it is limited from completing a full pendulum swing. On the other hand, activating the linear actuator 201 to allow the floating pulley 115 to be pulled upward (i.e., by the existing tension in the stabilizer cable 111 that is provided by load 101) gives the load 101 more leeway to swing horizontally.

The linear actuator 201 should be capable of applying any one of (a) a tightening force to increase the tension in the stabilizer cable, (b) a holding force to maintain a constant tension in the stabilizer cable, or (c) a loosening force operable to decrease the tension in the stabilizer cable. In one embodiment, each of these forces (tightening, holding, and loosening) is calculated at a specific quantity, and may take into account the specifications of the crane (e.g., size and horizontal distance between the load 101 and the lower boom 133), the specifications of the load 101 (e.g., weight, fragility, or size of the load 101), or the current altitude of the load 101 as held by the crane. In another embodiment, each of these forces (tightening, holding, and loosening) is actually a range of possible force quantities.

Though the method and system described herein and depicted in FIG. 1 and FIG. 2 is described as a method and system for stabilizing a load 101 being held by a crane, it could alternately be used in the opposite manner, for a purposeful movement (or "de-stabilization") of a load 101. For example, if the load 101 is a wrecking ball (or some analogue to a wrecking ball), an operator of the crane could apply the tightening force to the pulling mechanism (either the adjuster cable and winch or the linear actuator) to pull the wrecking ball load 101 substantially horizontally toward the crane to get the wrecking ball load 101 into a "ready" position. At that point, the operator of the crane could then switch the tightening force on the pulling mechanism to a lower holding force, once the wrecking ball load 101 is pulled back sufficiently. The operator of the crane could then maneuver the crane into demolishing position (e.g., using the turntable 153) if it was not already. The operator of the crane could then rapidly switch the holding force on the pulling mechanism to a lower loosening force, which suddenly drops the tension in the stabilizer cable 111 thereby allowing the wrecking ball load 101 to swing forward and demolish a structure. The stabilization and horizontal control system and method can also be used in a similar manner for the purpose of moving other types of the load 101 into a desired position without having to change the position of the base 151, the lower boom 133, or the upper boom 131.

Although different aspects of the invention are shown in different drawings (i.e., FIG. 1 and FIG. 2), and described in connection with their respective drawings, some aspects from one drawing can be combined with some aspects of another drawing to yield a different embodiment of the invention than shown in the figures. For example, FIG. 2 shows the case where the stabilizer mechanism uses (a) a linear actuator 201 as the pulling mechanism that generates a pulling force on the floating pulley 115, and (b) a deflector pulley 117 that is attached to the traveler pulley 119 instead of to the load assembly. Another embodiment of the invention (not shown) is a crane-based lifting system whose stabilizer mechanism uses an adjuster cable 121 and adjuster winch 123 as the pulling mechanism, to generate the pulling force on the floating pulley 115 (similar to what is shown in FIG. 1), but uses a deflector pulley 117 that is attached to the traveler pulley 119 (similar to what is shown in FIG. 2). Yet another possible embodiment (not shown) is a crane-based lifting system whose stabilizer mechanism uses a linear actuator 201 to generate the pulling force on the floating pulley 115 (similar to what is shown in FIG. 2) but uses a deflector pulley 117 that is attached to the ballast or to the hook or to the load (similar to what is shown in FIG. 1).

In some embodiments, the method and system described herein may be used with a robotic crane system. The method and system can provide the horizontal control mechanism for a completely robotic crane, which can be pre-programmed to be self-correcting to place loads at a desired location, and to copy and repeat any sequence of steps for any number of loads 101. In other embodiments, the crane can be partially robotic. For instance, the crane may be pre-programmed with "sequences" that an operator may select, or may be programmed on-the-fly by an operator. A partially robotic crane can also be pre-programmed to assist a human operator by providing automatic stabilization or "autopilot"-style guided movement of a load 101 to a position indicated by the human operator.

In some embodiments, the method and system described herein may be operated via remote control. For example, in many cranes, the cab in which the human operator sits is located on or near the base 151 of the crane. In some situations, the operator might not be able to see the load 101 from his position in the cab, or might have poor vision of the load 101 and how close it is to nearby buildings, trees, the crane boom 131, 133 itself, and other potential obstacles. In typical crane systems, human personnel other than the operator are typically positioned to see the load 101 and to communicate with the operator so that the operator can move the load 101 into the correct position. These personnel can also warn the operator if the load 101 begins to sway in a potentially dangerous manner. This creates an information delay that can slow down the positioning of the load 101 and can cause damage to the crane boom 131, 133, the load 101, as well as surrounding buildings and trees. The system and method described herein can be separately and remotely controlled in a wired or wireless manner (e.g., radio controls such as via satellite communication or cellular telephone network) to overcome this issue. For example, personnel who see the load 101 may be granted remote control of the horizontal control and stabilization system to directly control the horizontal movement of the load 101 and to act quickly to stabilize the load 101 if it begins to sway in a potentially dangerous manner. Meanwhile, the crane operator may continue to independently adjust the angle of the crane boom and the altitude of the load (by separately activating the lifting winch 109 and/or the length of the guy line 141). Granting personnel with better vision of the load 101 the ability to remotely control the load 101, or remotely assist in control or stabilization of the load 101, can make positioning the load 101 easier, faster, safer, and more accurate.

Another embodiment of the invention is a method for stabilizing or controlling the horizontal position of a load that is held by a hook of a crane. The crane includes a boom, a lifting cable, and wherein a first end of the lifting cable is wrapped around a lifting winch. The lifting cable is coupled to the hook. The method includes coupling a first end of a stabilizer cable to the load, and passing the stabilizer cable through a boom pulley that is coupled to the crane boom, a traveler pulley, and a floating pulley that is attached to a pulling mechanism. In one embodiment, the stabilizer cable is further passed through a deflector pulley that is coupled to the load, and a second end of the stabilizer cable is attached to the traveler pulley. In another embodiment, the stabilizer cable is passed through a deflector pulley that is attached to the traveler pulley, and the second end of the stabilizer cable is coupled to the load. In both embodiments, activating the pulling mechanism to pull the floating pulley downward will increase tension along the stabilizer cable. Also in both embodiments, holding the floating pulley in place results in holding constant the tension in the stabilizer cable. Finally, activating the pulling mechanism to allow the floating pulley to be pulled upward (by the existing tension in the stabilizer cable) will decrease tension in the stabilizer cable. Making these changes in the tension of the stabilizer cable will result in the load being moved horizontally closer to the boom of the crane and away from the boom of the crane, as well as being kept still in a sideways direction, all without having to move the boom of the crane or a base of the crane. This allows the stabilizing or horizontal positioning control of the load to be performed independently of its lifting and lowering (through activation of the lifting winch), as well as independent of rotation of the base of the crane (which rotates the boom and therefore the load along an arc in a horizontal plane).

Viewed another way, and seen in FIG. 1 and FIG. 2, the stabilizer cable forms a closed loop in either of the embodiments described above, i.e. both when the deflector pulley is attached to the traveler pulley and when the deflector pulley is coupled to the load. When the lifting winch is activated in one direction (to take in the lifting cable and thereby raise the load), the closed loop rotates in one direction. When the lifting winch is activated in an opposite direction (to let out the lifting and thereby allow the load to undergo a controlled fall) the closed loop rotates in an opposite direction. In other words, the closed loop (formed by the stabilizer cable 111) automatically rotates in one direction and in an opposite direction, without any intervention by the pulling mechanism, in response to the lifting winch 109 raising and lowering the load 101, respectively.

In the foregoing specification, the embodiments of the invention have been described with reference to specific embodiments thereof. It will, however, be evident that various modifications and changes can be made thereto without departing from the broader spirit and scope of the invention as set forth in the appended claims. For example, although the drawings show a single line for the lifting cable 107 running from the load assembly up around the upper sheave 163 and then down towards the lifting winch 109, the crane could instead have a multiple sheave arrangement around which the lifting cable is looped, to obtain mechanical advantage for lifting heavier loads. In those instances, the end of the lifting cable may not be attached to the ballast 105 as shown but instead could be tied to the crane boom or the crane base. The specification and drawings are, accordingly, to be regarded in an illustrative rather than a restrictive sense.

What is claimed is:

1. A system for sideways positioning or stabilizing of a load that is suspended from a crane, the system comprising:

a crane boom;

a lifting cable running alongside the crane boom and to be coupled to a load so as to suspend the load;

a boom pulley attached to the crane boom;

a floating pulley;

a means for pulling the floating pulley;

a traveler pulley;

a deflector pulley; and a stabilizer cable with a first end and a second end, wherein the first end is to be coupled to the load, and wherein the stabilizer cable is to then loop around the boom pulley, then run through the traveler pulley, then loop around the floating pulley, and then loop around the deflector pulley, wherein the deflector pulley and the second end of the stabilizer cable are positioned such that an increase in tension of the stabilizer cable urges the suspended load toward the traveler pulley.

2. The system of claim 1, wherein the means for pulling the floating pulley is one of: (a) an adjuster rope and an adjuster drum winch, (b) an adjuster rope and an adjuster traction winch, (c) a linear actuator with a hydraulic motor, (d) a linear actuator with a pneumatic motor, or (e) a linear actuator with an electro-mechanical motor.

3. The system of claim 1, wherein the deflector pulley is attached to the load, or to a ballast that is attached to the lifting cable, or to a hook from which the load is suspended, and further wherein the second end of the stabilizer cable is attached to the traveler pulley.

4. The system of claim 1, wherein the deflector pulley is attached to the traveler pulley, and further wherein the second end of the stabilizer cable is attached to one of (a) the load, (b) a ballast that is attached to the lifting cable, or (c) a hook to which the load is attached.

5. The system of claim 1, wherein the means for pulling is operable to apply one of (a) a tightening force that increases the tension in the stabilizer cable by moving the floating pulley downward, (b) a holding force that maintains the same tension in the stabilizer cable by maintaining the position of the floating pulley, or (c) a loosening force that decreases the tension in the stabilizer cable thereby allowing the floating pulley to move upward due to the tension of the stabilizer cable that is looped around the floating pulley.

6. The system of claim 5 further comprising a crane base to which the crane boom is attached, wherein applying the tightening force by the pulling means is operable to move the suspended load horizontally or sideways so that the load is moved closer to the traveler pulley without moving the crane boom.

7. The system of claim 5 further comprising a crane cab in which a human operator is to be positioned when operating the crane to lift and lower the suspended load, wherein forces applied by the means for pulling are controlled by one of (a) a control interface in the crane cab, or (b) a wireless radio-signal remote control device.

8. The system of claim 1, wherein the load is a wrecking ball.

9. A system for use with a crane that suspends a load from a hook, the crane including a boom and a lifting cable, a first end of the lifting cable wrapped around a lifting winch, the lifting cable coupled to the hook, the system comprising:

a stabilizer cable having a first end and a second end;

a first attachment mechanism that couples the first end of the stabilizer cable to the hook;

a boom pulley coupled to the boom, wherein the stabilizer cable runs from the first attachment mechanism to wrap around the boom pulley;

a floating pulley, wherein the stabilizer cable runs from the boom pulley to wrap around the floating pulley;

a traveler pulley positioned to travel along a section of the stabilizer cable between the boom pulley and the floating pulley;

a pulling mechanism, wherein the floating pulley is coupled to the pulling mechanism;

a deflector pulley coupled to the hook or the traveler pulley, wherein the stabilizer cable runs from the floating pulley to wrap around the deflector pulley; and a second attachment mechanism that couples the second end of the stabilizer cable to the hook or the traveler pulley, and wherein the stabilizer cable runs from the deflector pulley to the second attachment mechanism.

10. The system of claim 9, wherein the pulling mechanism comprises:

an adjuster cable, wherein a first end of the adjuster cable is attached to the floating pulley; and an adjuster winch, wherein a second end of the adjuster cable is wrapped around the adjuster winch.

11. The system of claim 10, wherein the adjuster winch is a drum winch.

12. The system of claim 9, wherein the pulling mechanism comprises:

a linear actuator rod attached to the floating pulley; and a motor to power the linear actuator rod, the motor being one of (a) hydraulic, (b) pneumatic, or (c) electro-mechanical.

13. The system of claim 9, wherein the pulling mechanism is operable to apply one of (a) a tightening force to increase the tension in the stabilizer cable, (b) a holding force to maintain tension in the stabilizer cable, or (c) a loosening force operable to decrease the tension in the stabilizer cable.

14. The system of claim 13, wherein applying the tightening force of the pulling mechanism is operable to move the suspended load substantially horizontally so that the load is moved closer to the boom of the crane, without moving the boom of the crane and without moving a base of the crane to which the boom is attached.

15. The system of claim 9, wherein the deflector pulley is attached to the traveler pulley and the second attachment mechanism couples the second end of the stabilizer cable to the hook.

16. The system of claim 9, wherein the deflector pulley is coupled to the hook, and the second attachment mechanism attaches the second end of the stabilizer cable to the traveler pulley.

17. A method for stabilizing or controlling horizontal positioning of a load that is held by a hook of a crane, the crane including a boom, a lifting cable, a first end of the lifting cable wrapped around the lifting winch, and wherein the lifting cable is coupled to the hook, the method comprising:

coupling a first end of a stabilizer cable to the load;

passing the stabilizer cable through a boom pulley that is coupled to the crane boom;

passing the stabilizer cable through a traveler pulley;

passing the stabilizer cable through a floating pulley that is attached to a pulling mechanism; and one of (i) passing the stabilizer cable through a deflector pulley that is coupled to the load and attaching a second end of the stabilizer cable to the traveler pulley, or (ii) passing the stabilizer cable through a deflector pulley that is attached to the traveler pulley and coupling a second end of the stabilizer cable to the load.

18. The method of claim 17, further comprising:

activating the pulling mechanism to pull the floating pulley downward, hold the floating pulley in place, and allow the floating pulley to be pulled upward, thereby respectively increasing, holding, and decreasing tension along the stabilizer cable.

19. The method of claim 18, wherein activating the pulling mechanism to increase tension in the stabilizer cable is operable to move the load substantially horizontally closer to the boom of the crane without moving the boom of the crane or a base of the crane.

20. The method of claim 17, wherein the stabilizer cable forms a closed loop, the method further comprising activating the lifting winch in one direction to take in the lifting cable and thereby raise the load, and activating the lifting winch in an opposite direction to let out the lifting cable and thereby lower the load, wherein the closed loop of the stabilizer cable automatically rotates in one direction while the load rises and in an opposite direction while the load falls.

* * * * *